US007637291B2

(12) United States Patent
Boeck

(10) Patent No.: US 7,637,291 B2
(45) Date of Patent: Dec. 29, 2009

(54) FORMING MESH

(75) Inventor: Johann Boeck, Fornach (AT)

(73) Assignee: Voith Patent GmbH, Heidenheim (DE)

( * ) Notice: Subject to any disclaimer, the term of this patent is extended or adjusted under 35 U.S.C. 154(b) by 68 days.

(21) Appl. No.: 12/110,632

(22) Filed: Apr. 28, 2008

(65) Prior Publication Data

US 2008/0264511 A1 Oct. 30, 2008

(30) Foreign Application Priority Data

Apr. 28, 2007 (DE) ..... 10 2007 020 071

(51) Int. Cl.
*D03D 3/04* (2006.01)
*D21F 7/08* (2006.01)
*D03D 23/00* (2006.01)
*D03D 25/00* (2006.01)

(52) U.S. Cl. ..... 139/383 A; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 4,071,050 A * 1/1978 Codorniu ..... 139/383 R
5,016,678 A * 5/1991 Borel et al. ..... 139/383 A
5,151,316 A * 9/1992 Durkin et al. ..... 428/213
5,219,004 A * 6/1993 Chiu ..... 139/383 A
5,826,627 A * 10/1998 Seabrook et al. ..... 139/383 A
5,881,764 A * 3/1999 Ward ..... 139/383 A
5,967,195 A * 10/1999 Ward ..... 139/383 A
6,123,116 A * 9/2000 Ward et al. ..... 139/383 A
6,145,550 A * 11/2000 Ward ..... 139/383 A
6,179,013 B1 * 1/2001 Gulya ..... 139/383 A
6,202,705 B1 * 3/2001 Johnson et al. ..... 139/383 A
6,223,780 B1 * 5/2001 Kaldenhoff ..... 139/383 A
6,244,306 B1 * 6/2001 Troughton ..... 139/383 A
6,253,796 B1 * 7/2001 Wilson et al. ..... 139/383 A
6,334,467 B1 * 1/2002 Barrett et al. ..... 139/383 A
6,533,901 B2 * 3/2003 Taipale ..... 162/348
6,581,645 B1 * 6/2003 Johnson et al. ..... 139/383 A
6,854,488 B2 * 2/2005 Hay et al. ..... 139/383 A
6,978,809 B2 * 12/2005 Quigley ..... 139/383 A
7,059,359 B2 * 6/2006 Quigley et al. ..... 139/383 A
7,249,615 B2 * 7/2007 Westerkamp et al. ... 139/383 A
7,415,993 B2 * 8/2008 Hay et al. ..... 139/383 A
7,431,802 B2 * 10/2008 Quigley et al. ..... 162/348
7,503,350 B2 * 3/2009 Quigley ..... 139/383 A
7,506,670 B2 * 3/2009 Hay ..... 139/383 A
7,571,746 B2 * 8/2009 Hay et al. ..... 139/383 A
2004/0118473 A1 * 6/2004 Hay et al. ..... 139/383 R
2006/0016505 A1 * 1/2006 Westerkamp ..... 139/383 A (Continued)

*Primary Examiner*—Bobby H Muromoto, Jr.
(74) *Attorney, Agent, or Firm*—Taylor & Aust, P.C.

(57) ABSTRACT

A paper machine mesh, in particular a forming mesh, includes an upper and a lower fabric layer and binder threads to join the two fabric layers, the lower fabric layer having a weaving pattern which is repeated in lower repeats. Within the lower repeat, each binder thread of each pair with lower longitudinal threads forms at least one tie segment and each tie segment is formed in that the respective binder thread of the pair continually crosses two or more directly consecutive lower longitudinal threads on the outer side of the lower fabric layer, and the tie segments of each binder thread pair are arranged relative to the lower transverse threads flanking said segments.

16 Claims, 3 Drawing Sheets

U.S. PATENT DOCUMENTS

2006/0016509 A1* 1/2006 Westerkamp et al. ... 139/383 R
2007/0028996 A1* 2/2007 Quigley ..... 139/383 R
2008/0105323 A1* 5/2008 Hay et al. ..... 139/383 A
2009/0035537 A1* 2/2009 Hack-Ueberall et al. .... 428/196

* cited by examiner 103
100

102
2 floats locked in WS knuckles, Bi reversing
101
104
T1
B1
T2
B2
i1
i2
S2
S1
T3
B3
T4
B4
i3
i4
S4
S3
T5
B5
T6
B6
i5
i6
S5
S6
T7
B7
T8
B8
i7
i8
S7
S8
S7
T9
B9
T10
B10
i9
i10
S9
S10
T11
B11
T12
B12
i11
i12
S11
S12
T13
B13
T14
B14
i13
i14
S13
S14
T15
B15
T16
B16
i15
i16
S15
S16
T17
B17
T18
B18
i17
i18
S18
S17
S18
T19
B19
T20
B20
i19
i20
S20
S19

FORMING MESH

BACKGROUND OF THE INVENTION

1. Field of the Invention

This invention relates to a paper machine mesh, in particular a forming mesh.

2. Description of the Related Art

Forming meshes are used in the forming section of a paper machine. During the forming process, a fiber suspension from the headbox of the paper machine is applied to one forming mesh or to two forming meshes (in the case of gap formers). It is an object of the forming mesh in this case to dewater the fiber suspension and to form a fibrous web, whereby as little cellulose fiber and filler material as possible should be separated from the fiber suspension during the dewatering process.

The quality of the formed fibrous web is co-defined in this case to a great extent by the structure of the surface of the forming mesh facing the fibrous web (paper side). The life of the forming mesh, on the other hand, is greatly influenced by the structure of the surface of the forming mesh facing the paper machine (machine side).

To be able to take account of these in part contradictory requirements, multilayer paper machine meshes with a paper-side fabric layer and a machine-side fabric layer were developed, whereby the two fabric layers are connected to each other by so-called binders. To guarantee as uniform a paper-side fabric structure as possible, the binder threads are preferably an integral component of the paper-side weaving structure (integral binder threads), as the result of which a tendency to marking due to the tying of the binder threads is reduced.

On the weft-tied paper machine meshes with integral interchanging binder threads known from the prior art, the binder threads weave alternately with warp threads of the upper and the lower fabric layer, whereby each binder thread is woven as a rule with several upper warp threads before said binder thread crosses a single lower warp thread on the outer side of the lower fabric layer in order to form a tie-on point and subsequently to weave again with several upper warp threads.

The known meshes of said kind have the disadvantage that the lower fabric layer is tied at each tie-on point only by way of one warp thread to the upper fabric layer, as the result of which a high force acts on said warp thread and pulls it into the inside of the mesh, thus exerting a negative effect on the flatness of the mesh.

Furthermore, the binder threads on the known meshes of said kind often cover a large distance between the upper and the lower fabric layer, as the result of which the meshes known from the prior art are often very thick and therefore carry a lot of water.

In addition, the meshes known from the prior art often display a dewatering behavior which varies greatly over the mesh surface and can lead to hydraulic marking of the paper formed on such meshes.

Furthermore, on the known meshes the binder threads between the fabric layers are often exposed to high wear because often said threads are not sufficiently fixed between the fabric layers.

What is needed in the art is a paper machine mesh on which the disadvantages previously referred to no longer arise or arise at least to a reduced extent only.

SUMMARY OF THE INVENTION

The inventive paper machine mesh, in particular forming mesh, has an upper and a lower fabric layer and binder threads to join the two fabric layers. The outer side of the upper fabric layer provides the side of the mesh which can be moved into contact with the paper web, while the outer side of the lower fabric layer provides the side of the mesh which can be moved into contact with the machine.

The lower fabric layer of the paper machine mesh is formed furthermore by the binder threads, by lower transverse threads and by lower longitudinal threads which are woven with the binder threads and the lower transverse threads and extend transverse thereto. The lower fabric layer has a weaving pattern which is repeated in lower repeats. On the inventive paper machine mesh the binder threads are arranged in pairs. In addition, the binder threads of each pair are interchangingly woven with upper and with lower longitudinal threads. Furthermore, each binder thread pair is flanked on both sides respectively by one lower transverse thread, whereby each of the two flanking lower transverse threads is woven in periodic sequence with lower longitudinal threads as follows:

i) the flanking lower transverse thread continually crosses several directly consecutive lower longitudinal threads on the outer side of the lower fabric layer; and ii) the flanking lower transverse thread continually crosses a lower longitudinal thread between the upper and the lower fabric layer and forms a thread knuckle.

The inventive paper machine mesh is characterized in that within the lower repeat each binder thread of each pair forms together with lower longitudinal threads at least one segment, each segment being formed in that the respective binder thread of the pair continually crosses two or more directly consecutive lower longitudinal threads on the outer side of the lower fabric layer, and in that within the lower repeat the segments of each binder thread pair are arranged relative to the lower transverse threads flanking said segments such that:

i) the two flanking lower transverse threads continually cross on the outer side of the lower fabric layer at least the same lower longitudinal threads which together with the binder threads of the pair form the lower segments;

ii) the one of the two flanking lower transverse threads forms respectively one knuckle with the lower longitudinal thread which directly precedes the corresponding lower segment; and iii) the other of the two flanking lower transverse threads forms respectively one knuckle with the lower longitudinal thread which directly follows the corresponding lower segment.

When weaving with the lower longitudinal threads, the binder threads form segments which extend over two or more consecutive lower longitudinal threads, hence the binder threads extend to a greater extent on the outer side of the lower fabric layer and not between the fabric layers, as the result of which the thickness of the mesh and disadvantages connected therewith are clearly reduced.

The inventive characteristic that each binder thread weaves over at least two consecutive lower longitudinal threads means furthermore that, when weaving with the lower longitudinal threads, each binder thread extends "flatly" along the outer side of the lower fabric layer and is protected against wear by the lower transverse threads which flank said binder thread on both sides and as a rule have a larger cross-section than the binder threads, thus clearly reducing the risk of delamination of the two fabric layers. Furthermore, within the lower repeat the one of the two flanking lower transverse threads forms respectively one knuckle with the lower longitudinal thread directly preceding the corresponding tie segment and the other of the two flanking lower transverse threads forms respectively one knuckle with the lower longitudinal thread directly following the corresponding tie segment, hence each tie segment of the lower repeat is held firmly in position, thus preventing a relative movement of the binder threads between the lower and upper fabric layer and clearly reducing the inner wear of the mesh resulting therefrom.

Furthermore, in the lower fabric layer the long floats of the lower transverse threads on the outer side of the lower fabric layer form dewatering channels in regions which extend between two lower transverse threads extending side by side and floating on the outer side. The two flanking lower transverse threads continually cross on the outer side of the lower fabric layer at least the same lower longitudinal threads which together with the binder threads of the pair form the lower segments, hence the cross-sections of the dewatering channels formed by the floats are reduced, thus reducing the otherwise uniform dewatering speed and with it the tendency toward marking.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
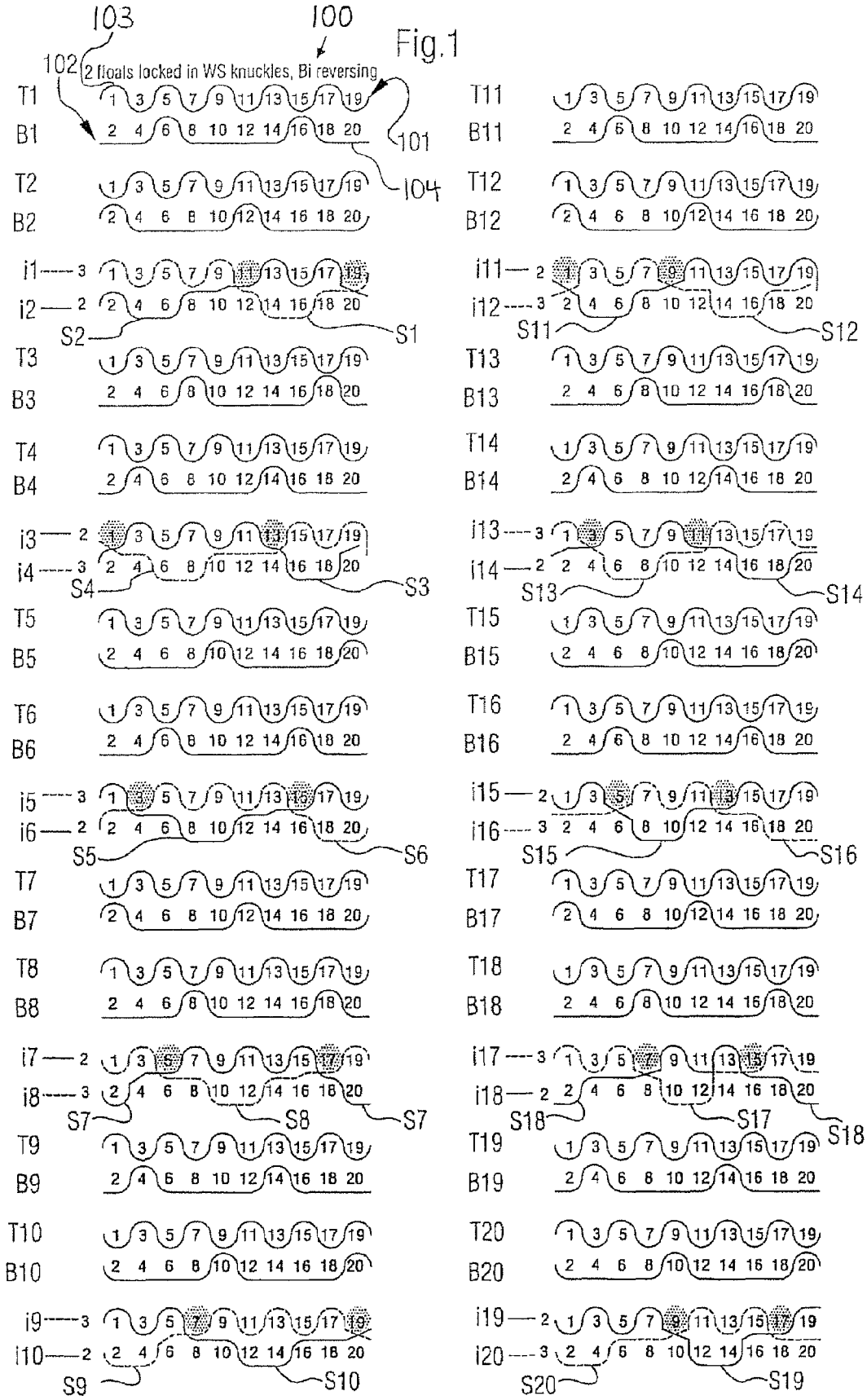
FIG. 1 shows a first embodiment of an inventive mesh in the transverse thread direction.

Referring now to the drawings, and more particularly to FIG. 1, there is shown, in the transverse thread direction, a first embodiment of an inventive paper machine mesh 100 constructed as a forming mesh. In the representation in FIG. 1 there is shown a repeat unit of the weave structure of the mesh 100.

The forming mesh 100 has upper longitudinal threads 1,3, 5,7,9,11,13,15,17 and 19 constructed as warp threads and lower longitudinal threads 2,4,6,8,10,12,14,16,18 and 20 constructed as warp threads. The longitudinal threads extend in this case perpendicularly from the drawing plane of FIG. 1.

Furthermore, the forming mesh 100 has binder threads it to i20 which are arranged in binder thread pairs i1 and i2, i3 and i4 to i19 and i20.

Also, the forming mesh 100 has upper transverse threads T1 to T20 constructed as weft threads and lower transverse threads B1 to B20 constructed as weft threads. On the forming mesh 100 presented in FIG. 1, the ratio of the number of binder thread pairs i1 and i2 to i19 and i20 and the upper transverse threads T1 to T20 together to the number of lower transverse threads B1 to B2 is 3:2.

The inventive forming mesh 100 has an upper fabric layer 101 and a lower fabric layer 102, whereby the two fabric layers 101 and 102 are joined together by the binder threads it and i2 to i19 and i20.

The upper fabric layer is formed by the binder threads i1 to i20, by the upper transverse threads T1 to T20 and by the upper longitudinal threads 1,3,5,7,9,11,13,15,17 and 19 which extend transverse to the binder threads i1 to i20 and the upper transverse threads T1 to T20 and are woven therewith. It also could be possible to form the upper fabric layer only by the upper longitudinal threads and the binder threads.

The lower fabric layer 102 is formed by the binder threads i1 to i20, by the transverse threads B1 to B2 and by the lower longitudinal threads 2,4,6,8,10,12,14,16,18 and 20 which extend transverse thereto and are woven therewith.

The binder threads of a pair are interchangingly woven with upper longitudinal threads 1,3,5,7,9,11,13,15,17 and 19 and with lower longitudinal threads 2,4,6,8,10,12,14,16,18 and 20 such that when the first binder thread of the pair is woven with upper longitudinal threads, the second binder thread of the pair is woven with lower longitudinal threads and when the second binder thread of the pair is woven with upper longitudinal threads, the first binder thread of the pair is woven with lower longitudinal threads.

The weaving pattern of the upper fabric layer 101 forms a linen bond, whereby the weaving pattern formed by the weaving of the upper longitudinal threads 1,3,5,7,9,11,13,15,17 and 19 with the upper transverse threads T1 to T20 is continued by the interchanging weaving of the binder threads i1 to i20 of the binder thread pairs with the upper longitudinal threads 1,3,5,7,9,11,13,15,17 and 19. Accordingly, when weaving with consecutive upper longitudinal threads 1,3,5,7, 9,11,13,15,17 and 19, each binder thread i1 to i20 crosses upper longitudinal threads 1,3,5,7,9,11,13,15,17 and 19 extending alternately on the outer side 103 of the upper fabric layer 101 and between the two fabric layers 101, 102.

As is evident from FIG. 1, the lower fabric layer has a weaving pattern which is repeated in lower repeats, whereby the lower repeat is formed by the lower longitudinal threads 2,4,6,8,10,12,14,16,18 and 20, the binder threads i1 to i20 and the lower transverse threads B1 to B20.

Each binder thread pair i1 and i2 to i19 and i20 is flanked on both sides respectively by one lower transverse thread B1 to B20, whereby each of the two flanking lower transverse threads B1 to B20 is woven in periodic sequence with lower longitudinal threads 2,4,6,8,10,12,14,16,18 and 20 as follows:

i) the flanking lower transverse thread continually crosses four directly consecutive lower longitudinal threads on the outer side 104 of the lower fabric layer 102; and ii) the flanking lower transverse thread continually crosses a lower longitudinal thread between the upper 101 and lower fabric layer 102 and forms a thread knuckle.

For example, the binder thread pair i1 and i2 is flanked on the one side by the lower transverse thread B2 and on the other side by the lower transverse thread B3.

On the embodiment in question, all the lower transverse threads B1 to B20 of the mesh 100 are woven in periodic sequence with lower longitudinal threads in the order stipulated above.

Provision is made according to the invention for each binder thread of a pair within the lower repeat to form with lower longitudinal threads at least one tie segment S1 to S20 and for each tie segment S1 to S20 to be formed in that the respective binder thread of the pair continually crosses at least two directly consecutive lower longitudinal threads on the outer side 104 of the lower fabric layer 102.

This means that for example the binder thread i1 of the binder thread pair i1 and i2 forms the tie segment S1 and the binder thread i2 of the binder thread pair i1 and i2 forms the tie segment S2 within the lower repeat. In this case the tie segment S1 is formed in that the binder thread i1 of the pair continually crosses the two directly consecutive lower longitudinal threads 14 and 16 on the outer side 104 of the lower fabric layer 102. Furthermore, the tie segment S2 is formed in that the binder thread i2 of the pair continually crosses the two directly consecutive lower longitudinal threads 4 and 6 on the outer side 104 of the lower fabric layer 102.

In addition, the segments are such that between two consecutive tie segments, for example S1, formed by the same binder thread, for example i1, said binder thread, for example i1, continually crosses at least one upper longitudinal thread, for example 1 and 3, on the outer side 103 of the upper fabric layer 101.

Furthermore, the tie segments of each binder thread pair within the lower repeat are arranged relative to the lower transverse threads flanking said segments such that the two flanking lower transverse threads continually cross on the outer side of the lower fabric layer at least the same lower longitudinal threads which together with the binder threads of the pair form the tie segments.

For example the lower transverse thread B2 and the lower transverse thread B3 continually cross on the outer side 104 of the lower fabric layer 102 respectively the lower longitudinal threads 4 and 6 and 14 and 16 which also form the tie segments S1 and S2.

Furthermore the one of the two flanking lower transverse threads forms respectively one knuckle with the lower longitudinal thread which directly precedes the corresponding tie segment.

This means that for example the lower transverse thread B2 forms a knuckle with the lower longitudinal thread 2 and with the lower longitudinal thread 12, whereby the lower longitudinal thread 2 directly precedes the tie segment S2 and the lower longitudinal thread 12 directly precedes the tie segment S1.

Furthermore provision is made according to the invention for the other of the two flanking lower transverse threads to form respectively one knuckle with the lower longitudinal thread which directly follows the corresponding tie segment.

For example the lower transverse thread B3 forms a knuckle with the lower longitudinal thread 8 and with the lower longitudinal thread 18, whereby the lower longitudinal thread 8 directly follows the tie segment S2 and the lower longitudinal thread 18 directly follows the tie segment S1.

As is evident from the representation in FIG. 1, the tie segments of the two binder threads are alternately arranged for each binder thread pair. For example the tie segments S1 and S2 alternate with each other. In this case, three lower longitudinal threads are always arranged between directly consecutive tie segments of a binder thread pair. This means for example that the three lower longitudinal threads 8, 10 and 12 and the three lower longitudinal threads 18, 20 and 2 are arranged between the directly consecutive tie segments S1 and S2.

Furthermore, each binder thread pair has a binder thread of a first kind i2, i4, i6, i8, i10, i12, i14, i16, i18 and i20 and a binder thread of a second kind i1, i3, i5, i7, i9, i11, i13, i15, i17 and i19, whereby in the upper repeat unit the binder thread of a first kind i2, i4, i6, i8, i10, i12, i14, i16, i18 and i20 crosses two upper longitudinal threads when it runs along the outer side 103 of the upper fabric layer 101 and the binder thread of a second kind i1, i3, i5, i7, i9, i11, i13, i15, i17 and i19 crosses three upper longitudinal threads when it runs along the outer side 103 of the upper fabric layer 101.

Furthermore, the tie segments formed by binder threads of the same kind from directly adjacent binder thread pairs are offset by one lower longitudinal thread relative to each other in the transverse thread direction and therefore overlap each other in part. This means that for example the binder threads of a first kind i2, i4, i6, i8, i10, i12, i14, i16, i18 and i20 form together with the corresponding lower longitudinal threads the tie segments S2, S4, S6, S8, S10, S12, S14, S16, S18 and S20, whereby for example the tie segments S2 and S4, which are arranged directly side by side, are arranged side by side with overlapping of the lower longitudinal thread 6 in the transverse thread direction.

Figure 2:
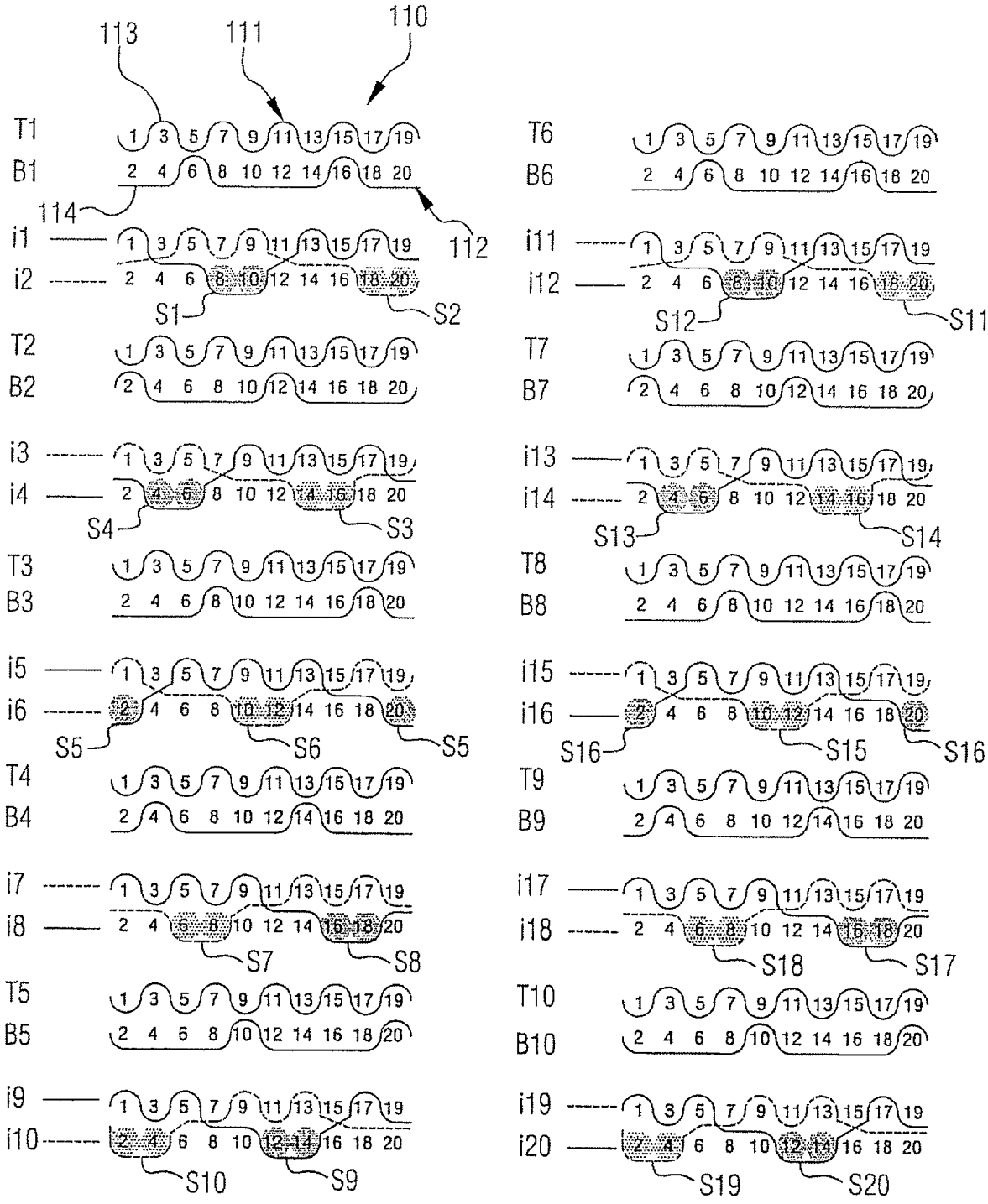
FIG. 2 shows a second embodiment of an inventive mesh in the transverse thread direction.

FIG. 2 shows a second embodiment of an inventive paper machine mesh 110 constructed as a forming mesh.

The mesh 110 presented in FIG. 2 differs essentially from the forming mesh 100 presented in FIG. 1 in that the ratio of the number of binder thread pairs i1 and i2 to i19 and i20 and upper transverse threads T1 to T10 together to the number of lower transverse threads B1 to B10 is 2:1. Mesh 100 includes the outer side 113 of the upper fabric layer 111 and the outer side 114 of the lower fabric layer 112.

Furthermore, tie segments formed by binder threads of the same kind from directly adjacent binder thread pairs are—unlike in FIG. 1—directly adjacent each other in the transverse thread direction. This means that for example the binder threads of a first kind i2, i3, i6, i7, i10, i11, i14, i15, i18 and i19 form together with the corresponding lower transverse threads the tie segments S2, S3, S6, S7, S10, S11, S14, S15, S18 and S19, whereby for example the tie segments S2 and S3, which are arranged directly side by side, are arranged directly—meaning without overlapping or spacing of one or more lower longitudinal threads—side by side.

On the forming meshes shown in FIGS. 1 and 2, the lower transverse threads have in addition a larger cross-sectional area than the binder threads.

Figure 3:
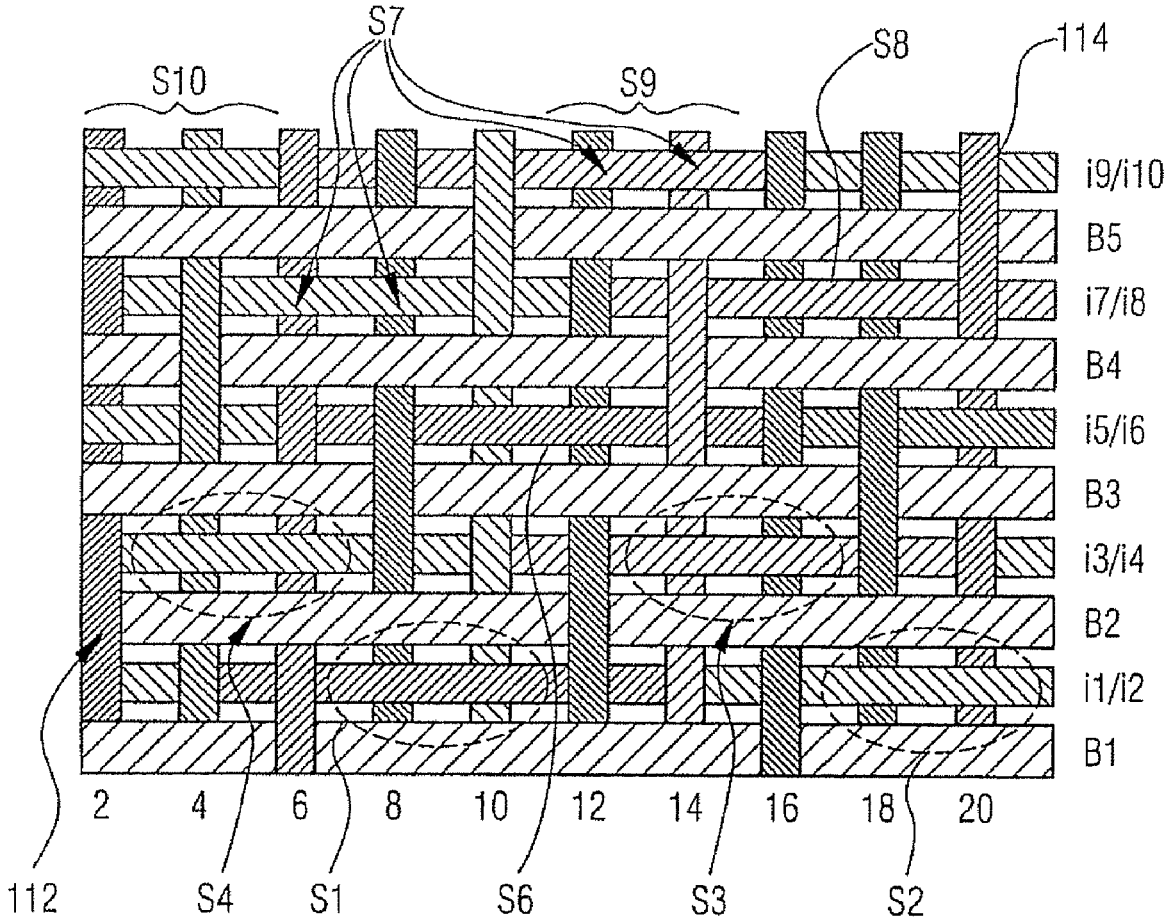
FIG. 3 shows the lower fabric layer of the mesh from FIG. 2.

FIG. 3 shows a representation of the lower fabric layer 112 over a part of the lower repeat looking to the outer side 114 of the lower fabric layer 112.

The inventive characteristics are clearly evident, namely that within the lower repeat:

i) each binder thread i1 to i20 of each pair with lower longitudinal threads 2,4,6,8,10,12,14,16,18 and 20 forms at least one tie segment S1 to S20 and each tie segment S1 to S20 is formed in that the respective binder thread i1 to i20 of the pair continually crosses two or more directly consecutive lower longitudinal threads 2,4,6,8,10,12,14,16,18 and 20 on the outer side 114 of the lower fabric layer 112; and ii) the tie segments S1 to S20 of each binder thread pair are arranged relative to the lower transverse threads B1 to B10 flanking said segments such that:

a) the two flanking lower transverse threads B1 to B10 continually cross on the outer side 114 of the lower fabric layer 112 at least the same lower longitudinal threads which together with the binder threads i1 to i20 of the pair form the tie segments S1 to S20;

b) the one of the two flanking lower transverse threads forms respectively one knuckle with the lower longitudinal thread which directly precedes the corresponding tie segment; and c) the other of the two flanking lower transverse threads forms respectively one knuckle with the lower longitudinal thread which directly follows the corresponding tie segment.

The binder thread pair i3 and i4 can be drawn on as an example. Within the lower repeat, the binder thread i3 forms together with the lower longitudinal threads 14 and 16 the tie segment S3 and the binder thread i4 forms together with the lower binder threads 4 and 6 the tie segment S4. The tie segment S4 is formed in that the binder thread i4 continually crosses the two directly consecutive lower longitudinal threads 4 and 6 on the outer side 114 of the lower fabric layer 112. The tie segment S3 is formed in that the binder thread i3 continually crosses the two directly consecutive lower longitudinal threads 14 and 16 on the outer side 114 of the lower fabric layer 112.

Furthermore, the tie segments S3 and S4 are arranged relative to the lower transverse threads B2 and B3 flanking said segments such that:

i) the two flanking lower transverse threads B2 and B3 continually cross on the outer side 114 of the lower fabric layer 112 the same lower longitudinal threads 4 and 6 which together with the binder thread i4 of the pair form the tie segment S4;

ii) the two flanking lower transverse threads B2 and B3 continually cross on the outer side 114 of the lower fabric layer 112 the same lower longitudinal threads 14 and 16 which together with the binder thread i3 of the pair form the tie segment S3;

iii) the flanking lower transverse thread B2 forms a knuckle with the lower longitudinal threads 2 and 12, whereby the longitudinal thread 2 directly precedes the tie segment S4 and the longitudinal thread 12 directly precedes the tie segment S3; and iv) the flanking lower transverse thread B3 forms a knuckle with the lower longitudinal threads 8 and 18, whereby the longitudinal thread 8 directly follows the tie segment S4 and the longitudinal thread 18 directly follows the tie segment S3.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A paper machine mesh, comprising:

an upper fabric layer including a plurality of upper longitudinal threads;

a lower fabric layer including an outer side;

a plurality of binder threads joining said upper and lower fabric layers, said lower fabric layer including said plurality of binder threads, a plurality of lower transverse threads, and, woven therewith and extending transversely thereto, a plurality of lower longitudinal threads, said lower fabric layer having a weaving pattern which is repeated in a plurality of lower repeats, said plurality of binder threads being arranged respectively in a plurality of binder thread pairs, said binder threads of each said binder thread pair being interchangingly woven with said plurality of upper longitudinal threads and said plurality of lower longitudinal threads, each said binder thread pair including two sides, each said binder thread pair being flanked on each of said two sides respectively by one said lower transverse thread which is thereby a flanking lower transverse thread, each of said two flanking lower transverse threads corresponding to a respective said binder thread pair being woven in a periodic sequence with said plurality of lower longitudinal threads as follows:

i) said flanking lower transverse thread continually crosses a plurality of directly consecutive said lower longitudinal threads on said outer side of said lower fabric layer, and ii) said flanking lower transverse thread continually crosses a respective said lower longitudinal thread between said upper and lower fabric layers and forms a thread knuckle, wherein within each said lower repeat:

i) each said binder thread of each said binder thread pair forms together with respective ones of said plurality of lower longitudinal threads at least one tie segment, each said tie segment being formed in that each respective said binder thread of each said binder thread pair continually crosses at least two directly consecutive said lower longitudinal threads on said outer side of said lower fabric layer, and ii) each said tie segment of each said binder thread pair is arranged relative to respective said lower transverse threads flanking each said tie segment such that:

a) said two flanking lower transverse threads corresponding respectively to each said binder thread pair continually cross on said outer side of said lower fabric layer at least the same said lower longitudinal threads which together with said binder threads of said binder thread pair form each said tie segment, b) one of said two flanking lower transverse threads forms respectively one said thread knuckle with a respective one of said lower longitudinal threads which directly precedes a corresponding said tie segment, and c) the other of said two flanking lower transverse threads forms respectively one said thread knuckle with a respective one of said lower longitudinal threads which directly follows a corresponding said tie segment.

2. The paper machine mesh according to claim 1, wherein said upper fabric layer includes an outer side and wherein, between two consecutive said tie segments formed by a same said binder thread, said same binder thread continually crosses at least one said upper longitudinal thread on said outer side of said upper fabric layer.

3. The paper machine mesh according to claim 1, wherein, within each said lower repeat, each said binder thread of said binder thread pairs forms together with said lower longitudinal threads exactly one said tie segment.

4. The paper machine mesh according to claim 1, wherein all said lower transverse threads are woven in said periodic sequence with said lower longitudinal threads as follows:

i) said flanking lower transverse thread continually crosses said plurality of directly consecutive lower longitudinal threads on said outer side of said lower fabric layer, and ii) said flanking lower transverse thread continually crosses said respective lower longitudinal thread between said upper and lower fabric layers and forms said thread knuckle.

5. The paper machine mesh according to claim 1, wherein each said lower transverse thread continually crosses four directly consecutive said lower longitudinal threads in said periodic sequence on said outer side of said lower fabric layer before said lower transverse thread continually crosses said respective lower longitudinal thread between said upper and lower fabric layers, thereby forming said thread knuckle.

6. The paper machine mesh according to claim 1, wherein three said lower longitudinal threads are arranged between directly consecutive said tie segments of a respective said binder thread pair.

7. The paper machine mesh according to claim 1, wherein said upper fabric layer includes said plurality of binder threads, a plurality of upper transverse threads, and said plurality of upper longitudinal threads which extend transverse to said plurality of binder threads and said plurality of upper transverse threads and are woven therewith.

8. The paper machine mesh according to claim 7, wherein said upper fabric layer has a weaving pattern formed by a weaving of said upper longitudinal threads with said upper transverse threads, said weaving pattern of said upper fabric layer being continued through an interchanging weaving of said binder threads of said binder thread pairs with said upper longitudinal threads.

9. The paper machine mesh according to claim 7, wherein said upper fabric layer includes an outer side, and wherein, when weaving with consecutive said upper longitudinal threads, each said binder thread crosses said upper longitudinal threads extending alternately on said outer side of said upper fabric layer and between said upper and lower fabric layers.

10. The paper machine mesh according to claim 7, wherein said upper fabric layer includes an outer side, wherein each said binder thread pair includes two kinds of said binder threads such that one said binder thread of said binder thread pair is of a first kind and one said binder thread of said binder thread pair is of a second kind, wherein said upper fabric layer has a weaving pattern which is repeated in a plurality of upper repeats, wherein, in each said upper repeat, said binder thread of said first kind crosses two said upper longitudinal threads when said binder thread of said first kind runs along said outer side of said upper fabric layer and said binder thread of said second kind crosses three said upper longitudinal threads when said binder thread of said second kind runs along said outer side of said upper fabric layer.

11. The paper machine mesh according to claim 10, wherein said tie segments formed by said binder threads of a same kind from directly adjacent said binder thread pairs are arranged in a transverse thread direction side-by-side one of with overlapping and directly adjacent to each other.

12. The paper machine mesh according to claim 7, wherein said upper fabric layer forms a linen bond as a weaving pattern.

13. The paper machine mesh according to claim 7, wherein all said tie segments include a same number of directly consecutive said lower longitudinal threads.

14. The paper machine mesh according to claim 7, wherein a ratio of a number of said binder thread pairs and said upper transverse threads together to a number of said lower transverse threads is one of 1:1, 2:1, and 3:2.

15. The paper machine mesh according to claim 7, wherein said lower transverse threads have a larger cross-sectional area than said binder threads.

16. The paper machine mesh according to claim 7, wherein said upper and lower longitudinal threads are warp threads and said upper and lower transverse threads and said binder threads are weft threads.

* * * * *